US006175336B1

(12) United States Patent
Coughlin et al.

(10) Patent No.: US 6,175,336 B1
(45) Date of Patent: Jan. 16, 2001

(54) STRUCTURAL ENDCAP ANTENNA

(75) Inventors: Daniel Patrick Coughlin, Torrance; Allen John Lockyer, Huntington Beach; Michael David Durham, Ventura; Kevin Herman Alt, Huntington Beach; Peter Lacombe, Torrance; Jayanth Nandalke Kudva, Rancho Palos Verdes; Keith Alan Olsen, Lakewood, all of CA (US)

(73) Assignee: Northrop Grumman Corporation, Los Angeles, CA (US)

( * ) Notice: Under 35 U.S.C. 154(b), the term of this patent shall be extended for 0 days.

(21) Appl. No.: 09/472,497

(22) Filed: Dec. 27, 1999

(51) Int. Cl.[7] ..... H01Q 1/28
(52) U.S. Cl. ..... 343/708; 343/705
(58) Field of Search ..... 343/705, 708, 343/872, 878; H01Q 1/28

(56) References Cited

U.S. PATENT DOCUMENTS

| | | | |
|---|---|---|---|
| 2,279,130 | 4/1942 | Bruce . | |
| 2,589,664 | 3/1952 | Bowman . | |
| 2,612,606 | 8/1952 | Wehner . | |
| 2,614,219 | 10/1952 | Cary . | |
| 2,661,422 | 12/1953 | Johnson et al. . | |
| 2,700,104 | 1/1955 | Bowman . | |
| 2,701,307 | 2/1955 | Cary . | |
| 2,845,624 | 7/1958 | Burberry . | |
| 3,005,986 | 10/1961 | Reed . | |
| 3,086,204 | 4/1963 | Alford . | |
| 3,613,098 | 10/1971 | Blasko . | |
| 3,725,941 | 4/1973 | Stang . | |
| 3,868,693 | 2/1975 | Young . | |
| 4,392,139 | 7/1983 | Aoyama et al. . | |
| 4,675,686 | 6/1987 | Finken . | |
| 5,039,992 | 8/1991 | Lenormand et al. . | |
| 5,175,559 | 12/1992 | Schrank et al. . | |
| 5,184,141 | 2/1993 | Connolly et al. . | |
| 5,405,107 | 4/1995 | Bruno . | |
| 5,825,332 * | 10/1998 | Camacho et al. | 343/708 |
| 6,097,343 * | 8/2000 | Goetz et al. | 343/708 |

FOREIGN PATENT DOCUMENTS

| | | | |
|---|---|---|---|
| 704659 | 2/1954 | (GB) . | |
| 804666 | 11/1958 | (GB) . | |
| WO 91/20107 | 12/1991 | (WO) | H01Q/1/28 |

* cited by examiner

*Primary Examiner*—Don Wong
*Assistant Examiner*—Hoang Nguyen
(74) *Attorney, Agent, or Firm*—Terry J. Anderson; Karl J. Hoch, Jr.

(57) ABSTRACT

A structural endcap antenna for a vertical tail of an aircraft. The endcap antenna comprises an outer skin having an inner surface and an antenna element disposed adjacent to the inner surface of the outer skin. The antenna element is in electrical communication with an RF signal source. Disposed adjacent to the antenna element is an inner support structure electrically bonded thereto. The antenna element and the inner support structure are excited by the RF signal source and provide structural support to the endcap antenna.

37 Claims, 4 Drawing Sheets

STRUCTURAL ENDCAP ANTENNA

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to aircraft antennas and more particularly to an antenna component that is a structural member of the aircraft.

Modern aircraft have a need to provide radio communication over a variety of frequency ranges and communication modes. For example, radio communication may be in the VHF band using amplitude modulation (AM) and/or frequency modulation (FM) or in the UHF band. In order to communicate effectively, the aircraft must include multiple antennas dispersed on the aircraft. Typically, the aircraft will include antennas mounted behind a radio transparent skin of the aircraft, and/or exterior blade antennas mounted to the skin of the aircraft.

For effective communication, the antenna dimensions should be in the same order of magnitude as the wavelength of the signal being propagated. In this respect, the wavelength for operation in the VHF/FM band (i.e., 30–88 MHz) is approximately 3–10 meters. Accordingly, for effective communication within this band range, the antenna must have a size correspondingly large. However, this is not practical because an antenna of this size would be aerodynamically inefficient. Therefore, small blade antennas electrically matched through impedance tuning networks are used. The blade antenna is a small fin protruding from the skin of the aircraft that is used as the radiating element.

Blade antennas are aerodynamically inefficient because they protrude from the skin of the aircraft. Typically, multiple blade antennas are used on the aircraft for the multiple communications bands (i.e., UHF, VHF/FM, VHF/AM). The blade antenna exhibits poor performance characteristics at lower frequencies (i.e., 30–88 MHz). The blade antenna is constructed to withstand the forces subjected to the antenna, however the blade antenna is still susceptible to impact damage (i.e., break off). The blade antenna does not add any structural strength to the aircraft, and interferes with the aerodynamic efficiency of the aircraft.

The present invention addresses the above-mentioned deficiencies in prior aircraft antenna design by providing an antenna that is a structural member of the aircraft. In this respect, the aircraft antenna of the present invention is a structural member of the aircraft tail that electrically couples the skin of the tail to the antenna in order to provide a radiating element. Accordingly, the tail member of the aircraft becomes the antenna radiating element.

BRIEF SUMMARY OF THE INVENTION

A structural endcap antenna for a vertical tail of an aircraft. The endcap antenna comprises an outer skin having an inner surface and an antenna element disposed adjacent to the inner surface of the outer skin. The antenna element is in electrical communication with an RF signal source. Disposed adjacent to the antenna element is an inner support structure bonded thereto. The antenna element and the inner support structure are excited by the RF signal source and provide structural support to the endcap antenna.

In a first embodiment of the present invention the antenna element may be graphite or copper mesh. The antenna element typically wraps around the inner support structure of the endcap antenna. The inner support structure typically comprises a conductive portion and a non-conductive portion. The conductive portion is typically bonded to the antenna element. In the present invention, the conductive portion is aluminum honeycomb and the non-conductive portion is glass honeycomb. Additionally, the outer skin of the antenna endcap is 3-ply fiberglass. The endcap of the present invention further includes an end rib disposed adjacent to a bottom end thereof. The end rib may be configured to be a ground plane for the antenna element and may be fabricated from electrically conductive graphite, or conductively finished fiberglass.

The first embodiment of the present invention may be fabricated from two halves. In this respect, the endcap antenna comprises a first half having a first outer skin, a first antenna element and a first inner support structure. The second half comprises a second outer skin, a second antenna element and a second inner support structure.

In a second embodiment of the present invention, the copper mesh is disposed between two halves of the inner support structure and separated by a center fiberglass section. Accordingly, the second embodiment of the endcap will consist of first and second outer skins bonded to respective halves of the inner support structure. Bonded to respective halves of the inner support structure will be a first and second antenna element which will be bonded together with the center fiberglass section.

BRIEF DESCRIPTION OF THE SEVERAL VIEWS OF THE DRAWING

These as well as other features of the present invention will become more apparent upon reference to the drawings wherein.

DETAILED DESCRIPTION OF THE INVENTION

Figure 1:
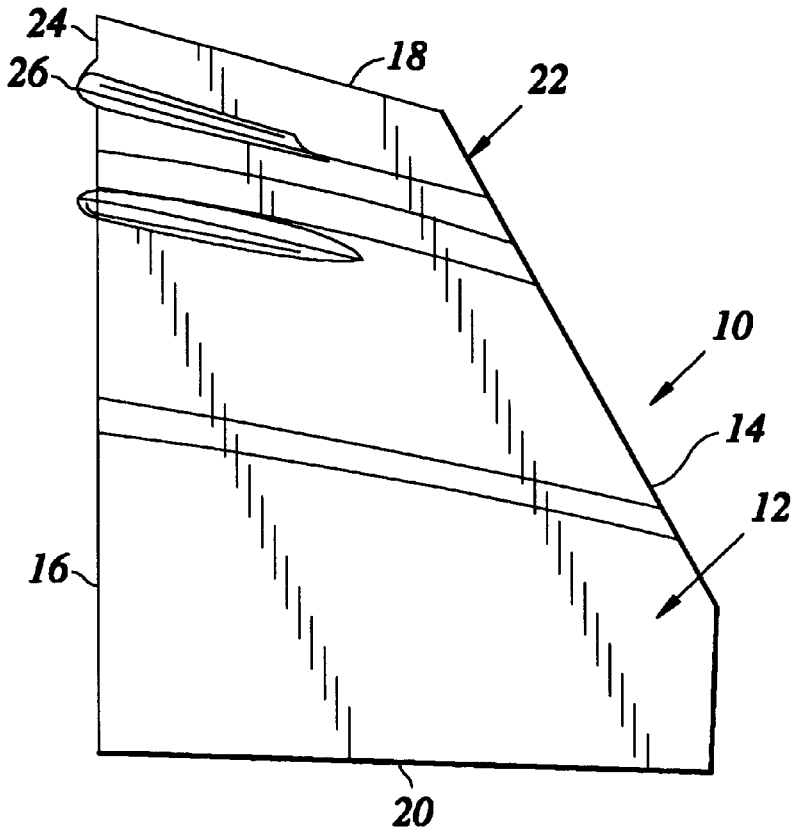
FIG. 1 is a perspective view of an aircraft tail having an endcap constructed in accordance with a first embodiment of the present invention.

Referring now to the drawings wherein the showings are for purposes of illustrating a preferred embodiment of the present invention only, and not for purposes of limiting the same, FIG. 1 illustrates a vertical tail 10 of an aircraft. The tail 10 comprises a graphite outer skin 12 that forms a protective barrier. The tail 10 has a leading edge 14, a trailing edge 16, and a top edge 18 on a top portion 22. Additionally, the tail 10 includes a bottom edge 20 that is attached to the aircraft. As will be recognized, the tail 10 is a structural component of the aircraft that aids in the control of the direction of the aircraft. The tail 10 typically is constructed from a material with sufficient strength to withstand the forces placed on the aircraft.

Disposed on the top portion 22 of the tail 10 is an endcap 24. The endcap 24 defines the top edge 18 of the tail 10. Typically, the endcap 24 is a removable component of the tail 10 and includes a light housing 26 that contains a light for the aircraft. The endcap 24 is a structural component of the tail 10 and must withstand forces exerted on the tail 10 during maneuvers by the aircraft.

In accordance with the present invention, the endcap 24 is an antenna radiating element that excites the outer skin 12 of the tail 10. In this regard, the endcap 24 will electrically excite the outer skin 12 of the tail 10 such that the entire tail 10 becomes an antenna, as described by U.S. Pat. No. 5,825,332 for MULTIFUNCTIONAL STRUCTURALLY INTEGRATED VHF-UHF AIRCRAFT ANTENNA SYSTEM, issued on Oct. 20, 1998, the contents of which are incorporated by reference herein. As will be recognized by those of ordinary skill in the art, it is advantageous for the entire tail 10 to be the radiating structure such that lower frequencies (i.e., 30–88 MHz) can be sent and received by the tail 10. Additionally, the tail 10 is an existing aerodynamic component of the aircraft such that there is no decrease in the aerodynamic efficiency of the aircraft by using the tail 10 as a radiating antenna element. In fact, by using the tail 10 as an antenna, existing blade antennas on the aircraft can be removed thereby increasing the aerodynamic efficiency of the aircraft.

Figure 3:
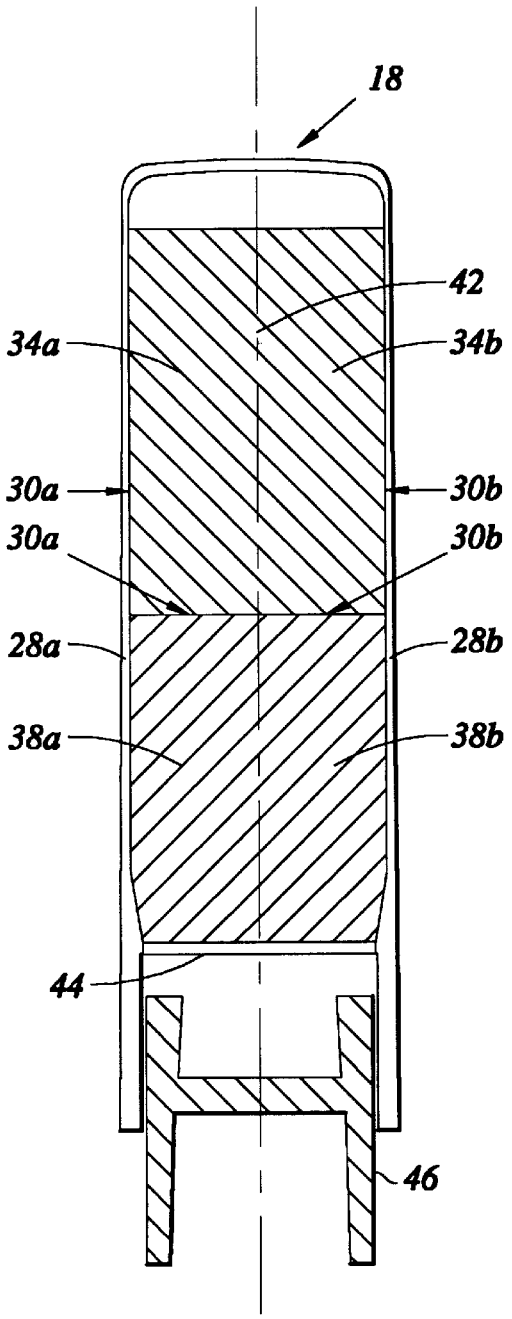
FIG. 3 is a cross-section view of the endcap taken along line A—A of FIG. 2.
Figure 4:
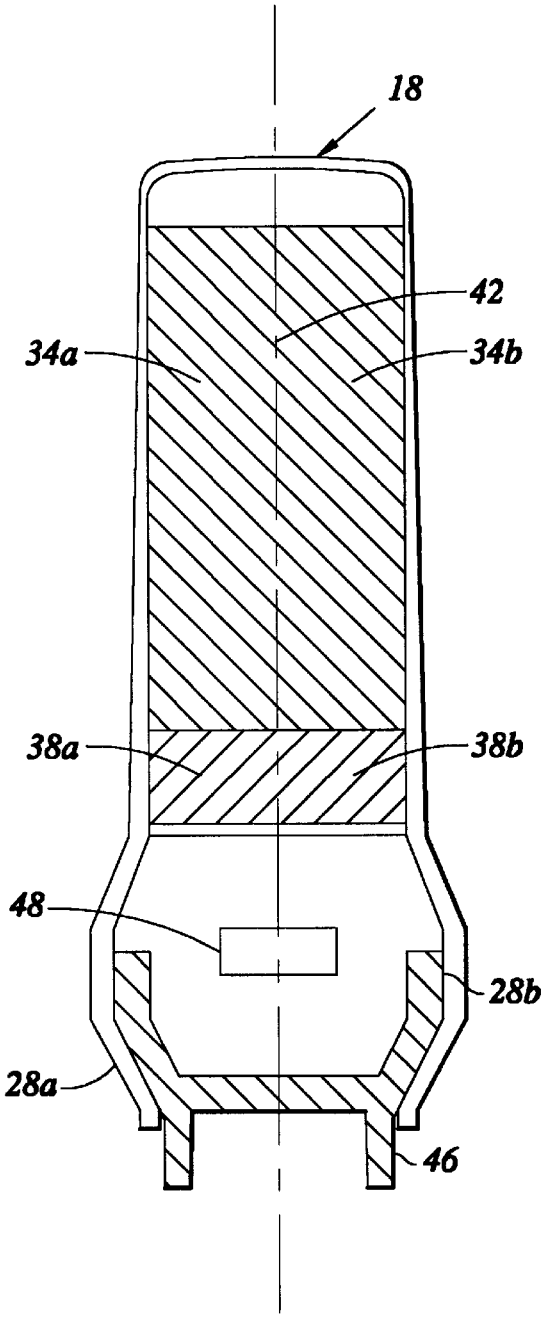
FIG. 4 is a cross-sectional view of the endcap taken along line B—B of FIG. 2.
Figure 5:
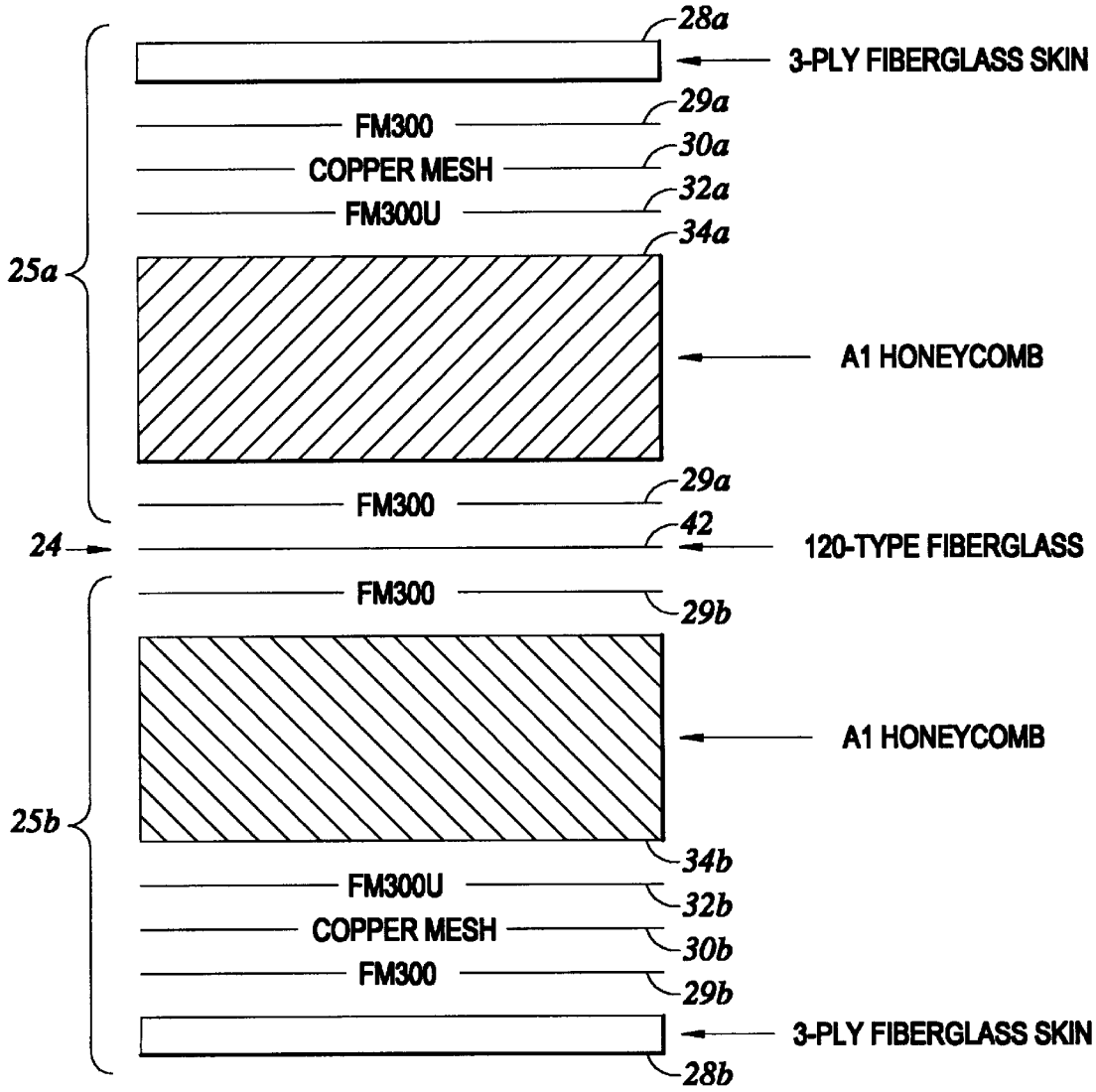
FIG. 5 is a cross-sectional representation of the materials for the endcap constructed in accordance with the first embodiment of the present invention and shown in FIG. 1.

Referring to FIGS. 3, 4, and 5, the endcap 24, constructed in accordance with the first embodiment of the present invention, is fabricated from a first half 25*a* and a second half 25*b*. Each of the halves 25*a*, 25*b* is a mirror image of each other such that the halves 25*a* and 25*b* can be bonded together to form the endcap 24. The first half 25*a* of endcap 24 includes a fiberglass outer skin 28*a*. Typically, the outer skin 28*a* is 3-ply S2 glass and epoxy that forms an outer protective barrier for the endcap 24, as well as providing strength thereto. Alternatively, the outer skin 28*a* may be fabricated from other non-conductive fabric/resin combinations such as astroquartz and cyanate resin. Bonded to an inner surface of the outer skin 28*a* is an electrically conductive copper mesh 30*a* that functions as an antenna element. In this respect, the copper mesh 30*a* is electrically connected to a transceiver of the aircraft through a wire (not shown) and provides the radiating element for the endcap 24. The copper mesh 30*a* is bonded to the outer skin 28*a* of the endcap 24 through the use of a layer of a scribed adhesive 29*a*, such as FM300, as seen in FIG. 5. Alternatively, the copper mesh 30*a* may be replaced with electrically conductive graphite. The graphite provides structural strength to the endcap 24 and can still radiate RF signals. The copper mesh 30*a* has a contour that matches a contour of an aluminum honeycomb support structure 24a (hereinafter aluminum honeycomb), as will be further explained below.

Figure 2:
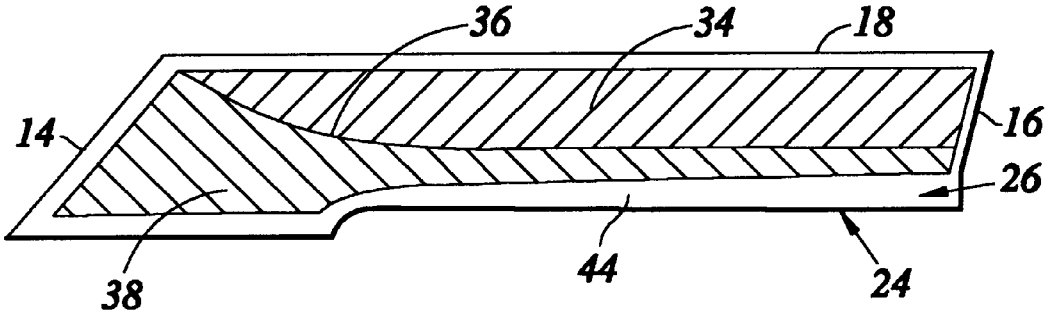
FIG. 2 is a cross-sectional view of the endcap shown in FIG. 1.

The aluminum honeycomb 34*a* is a bonded to the copper mesh 30*a* through the use of an unscribed adhesive 32. Referring to FIG. 2, the aluminum honeycomb 34*a* is configured to be placed on the top half of the endcap 24. In this respect, the aluminum honeycomb 34*a* is contoured with a lower edge 36*a* that is curved from the leading edge 14 of the endcap 24 and transitions generally horizontally to the trailing edge 16. As previously mentioned, the copper mesh 30*a* is bonded to the aluminum honeycomb 34*a*. Accordingly, the copper mesh 30*a* will have the same contour as the aluminum honeycomb 34*a*. Additionally, the copper mesh 30*a* may be wrapped around the lower edge 35*a* of the aluminum honeycomb 34*a*. By wrapping the copper mesh 30*a* around the lower edge 36*a* of the aluminum honeycomb 34*a*, the copper mesh 30*a* will surround the aluminum honeycomb 34*a* on three sides. In other words, the copper mesh 30*a* will form a U-shaped channel that surrounds the aluminum honeycomb 34*a*, as seen in FIGS. 3 and 4. The copper mesh 30*a* and the aluminum honeycomb 34*a* are bonded together such that they are in electrical communication with one another. Typically, the aluminum honeycomb 34*a* has a thickness slightly smaller than the thickness of the first half 25*a* of the endcap 24. Accordingly, the aluminum honeycomb 34*a* will confirm to the interior dimensions of the endcap 24. The aluminum honeycomb 34*a* provides structural strength to the endcap 24 because it is bonded to the outer skin 28*a* and the copper mesh 30*a*.

Referring to FIGS. 2, 3, and 4, the first half 25 of the endcap 24 includes a glass honeycomb support structure 38*a* (hereinafter glass honeycomb) disposed adjacent to the aluminum honeycomb 34*a*. The glass honeycomb 38*a* is electrically non-conductive such that RF signals radiated from the copper mesh 30*a* and the aluminum honeycomb 34*a* are not transmitted by the glass honeycomb 38*a*. The glass honeycomb 38*a* has a thickness conforming to the interior thickness of the endcap 24 such that the glass honeycomb 38*a* and the aluminum honeycomb 34*a* are substantially flush with each other. Because the glass honeycomb 38*a* is not bonded to the copper mesh 30*a*, the inner surface of the outer skin 28*a* will be bonded directly to the glass honeycomb 38*a* with the adhesive 29*a*. The glass honeycomb 38*a* is contoured complementary to the aluminum honeycomb 34*a*. In this respect, a top edge of the glass honeycomb 38*a* is in abutting contact with the lower edge 36*a* of the aluminum honeycomb 34*a*. Alternatively, if the copper mesh 30*a* is wrapped around the lower edge 36*a* of the aluminum honeycomb 34*a*, then the glass honeycomb 38*a* will be in abutting contact therewith. After the glass honeycomb 38*a* and the aluminum honeycomb 34*a* are bonded in place, the exposed (i.e., interior) surfaces are planed to a uniform level. In this regard, the aluminum and glass honeycomb 34*a* and 38*a* form a smooth, continuous inner surface that will be bonded to a corresponding surface of the second half 25*b* of the endcap 24.

Specifically, the second half 25*b* of the endcap 24 is formed identically to the first half 25*a*. Therefore, as seen in FIG. 5, the second half 25*b* of the endcap 24 includes a second outer skin 28*b*, a layer of adhesive 29*b*, and a second layer of copper mesh 30*b*. Bonded to the copper mesh 30*b* with unscribed adhesive 32*b* is a second aluminum honeycomb 34*b*. The copper mesh 30*b* may be wrapped around the aluminum honeycomb 34, as previously described for the first half 25*a* of the endcap 24. It will be recognized that the second half 25*b* of the endcap 24 will also include a glass honeycomb 38*b* disposed below the aluminum honeycomb 34*b*.

The first half 25*a* and the second half 25*b* of the endcap 24 are bonded together through the use of an adhesive 29*a* and 29*b* and a middle layer of fiberglass 42. As seen in FIG. 5, the middle layer of fiberglass 42 is attached to both halves of endcap 24 with the adhesive 29*a* and 29*b*. If the copper mesh 30*a* and 30*b* is wrapped under respective ones of the aluminum honeycomb 34*a* and 34*b*, then the copper mesh 30*a* and 30*b* forms a partial U-shaped channel around the aluminum honeycomb 34*a* and 34*b*, as previously described.

Referring to FIGS. 3 and 4, the endcap 24 further includes an end rib 44. The end rib 44 is formed from graphite or electrically conductive finished fiberglass and is positioned adjacent to the glass honeycomb 38 (i.e., the bottom of the endcap 24). The end rib 44 extends from the leading edge 14 to the trailing edge 16 of the endcap 24 and vertical tail 10. The end rib 44 is electrically connected to the aircraft tail 10 and electrically connected to a ground connection of the aircraft. In this respect, the end rib 44 functions as a ground plane for the copper mesh 30*a* and 30*b*. Additionally, the end rib 44 provides structural support to the endcap 24 and vertical tail 10.

The endcap 24 is attached to a conductive close-out rib 46 of the aircraft tail 10. The close-out rib 46 may be fabricated from graphite, aluminum, steel, or titanium. The bottom of the endcap 24 is placed over and attached to the close-out rib 46.

Referring to FIGS. 1 and 4, the endcap 24 is formed with the light housing 26, as previously mentioned. The light housing 26 is on the trailing edge 16 of the endcap 24 and vertical tail 10. Accordingly, the light housing 26 forms a void between the endcap 24 and the close-out rib 46. The void in the light housing 26 may be used for impedance matching electronics 48 for the endcap 24. It will be recognized that the void within the light housing 26 may be air-cooled thereby providing cooling for the electronics 48. Typically, the electronics 48 include connectors and impedance matching circuitry for the endcap 24 and are mounted through the use of a bracket. Because the electronics 48 are mounted within the light housing 26 they are easily accessible for repair and/or replacement.

Figure 6:
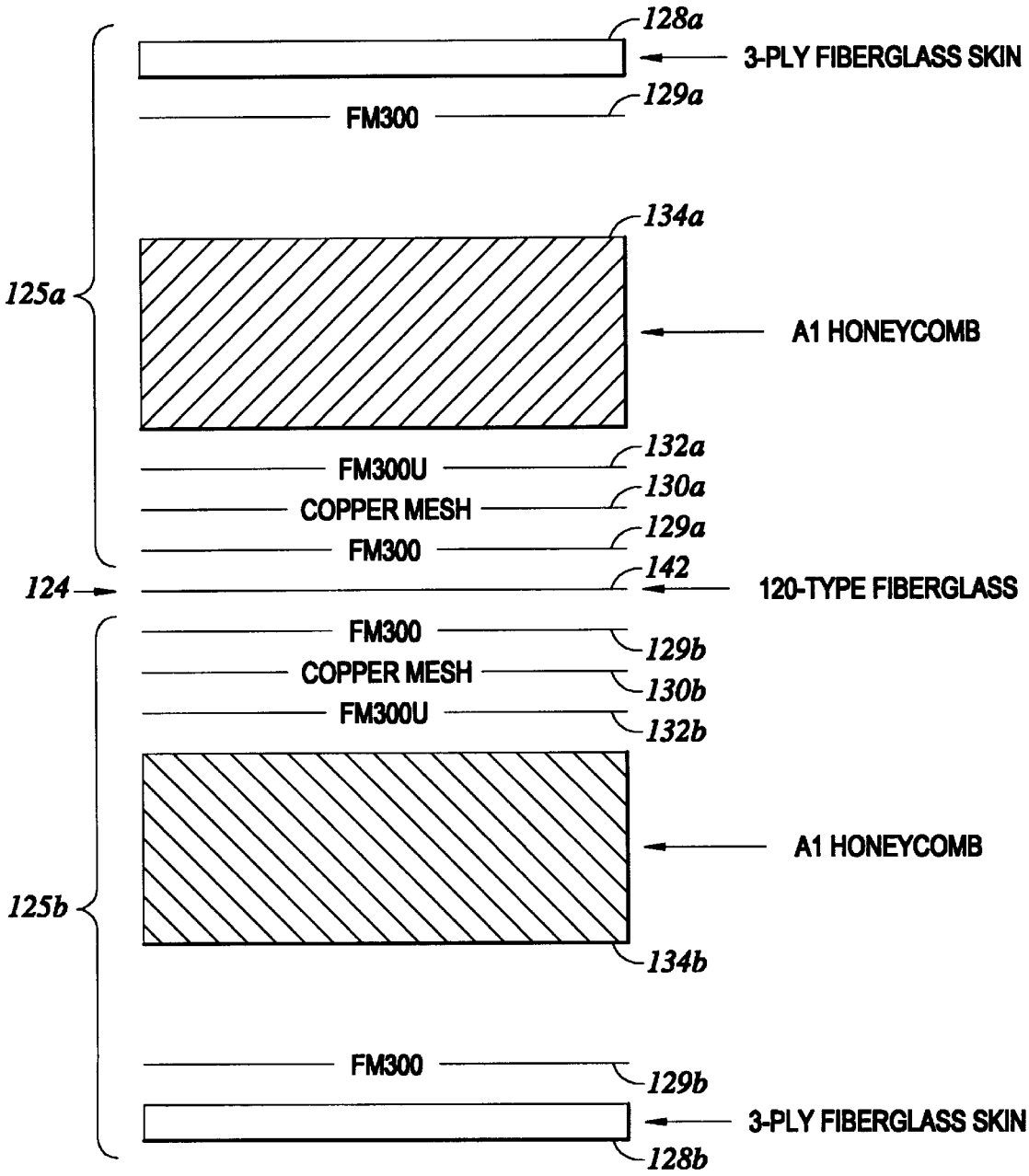
FIG. 6 is a cross-sectional representation of the materials for an endcap constructed in accordance with a second embodiment of the present invention.

Referring now to FIG. 6, a second embodiment of an endcap 124 is depicted. In the second embodiment, the copper mesh 130*a* and 130*b* is disposed within the interior of the endcap 124. Specifically, in the second embodiment, the endcap 124 comprises a first half 125*a* and identical 30 second half 125*b*. The first half 125*a* comprises an outer skin 128*a* of 3-ply fiberglass. Adhered to the outer skin 128*a* through the use of an adhesive 129*b* is an aluminum honeycomb 134*a*. It will also be recognized that a glass honeycomb (not shown) is additionally bonded to the outer skin 128*a*, in the manner described above for the first embodiment of the present invention.

Bonded to an interior surface of the aluminum honeycomb 134*a* is the copper mesh 130*a*. The copper mesh 130*a* is bonded with an unscribed adhesive 132*a*. The copper mesh 130*a* is functionally equivalent to the copper mesh 30*a*, as described for the first embodiment of the present invention. In this respect, the copper mesh 130*a* is electrically connected to the transceiver for the aircraft, and electrically excites the aluminum honeycomb 134*a* and the outer skin 128*a*.

The second half 125*b* of the second embodiment of the endcap 124 is identically configured to the first half 125*a*. Therefore, the second half 125*b* includes an outer skin 128*b* adhered with adhesive 129*b* to aluminum honeycomb 134*b*. Adhered to the aluminum honeycomb 134*b* with unscribed adhesive 132*b* is copper mesh 130*b*.

The first and second halves 125*a* and 125*b* are bonded together with a middle layer of fiberglass 142 and two layers of adhesives 129*a* and 129*b*. As will be recognized, after the first half 125*a* and the second half 125*b* are bonded together, a complete endcap 124 is formed. The second embodiment of the endcap 124 operates in a similar manner as the first embodiment of the endcap 24.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A structural endcap antenna for a vertical tail an aircraft, the endcap antenna comprising:

an outer skin having an inner surface;

an antenna element disposed adjacent to the inner surface of the outer skin, the antenna element being in electrical communication with an RF signal source; and an inner support structure disposed adjacent to the antenna element, the inner support structure bonded to the antenna element such that the outer skin, the antenna element and the inner support structure are excited by the RF signal source and provide structural support to the endcap antenna.

2. The endcap antenna of claim 1 wherein the antenna element is graphite.

3. The endcap antenna of claim 1 wherein the antenna element is copper mesh.

4. The endcap antenna of claim 3 wherein the inner support structure is a honeycomb structure.

5. The endcap antenna of claim 4 wherein the honeycomb structure is an aluminum honeycomb structure.

6. The endcap antenna of claim 4 wherein the inner support structure comprises a conductive portion and a non-conductive portion.

7. The endcap antenna of claim 6 wherein the conductive portion of the inner support structure is disposed adjacent to the antenna element.

8. The endcap antenna of claim 6 wherein the conductive portion is aluminum honeycomb and the non-conductive portion is glass honeycomb structure.

9. The endcap antenna of claim 1 wherein the outer skin comprises multiple plies of fiberglass.

10. The endcap antenna of claim 1 wherein the outer skin, the antenna element, and the inner support structure are bonded together through the use of an adhesive.

11. The endcap antenna of claim 1 wherein the endcap antenna has a bottom end and further comprises an end rib disposed adjacent to the bottom end thereof.

12. The endcap antenna of claim 11 wherein the end rib is configured as a ground plane for the antenna element.

13. The endcap antenna of claim 12 wherein the end rib is fabricated from graphite.

14. The endcap antenna of claim 13 wherein the end rib is fabricated from fiberglass with an electrically conductive finish.

15. The endcap antenna of claim 1 wherein the antenna element wraps around the inner support structure.

16. A structural endcap antenna for a vertical tail of an aircraft, the endcap antenna comprising:

a first half having:

a first outer skin having an inner surface;

a first electrically conductive antenna element disposed adjacent to the inner surface of the first outer skin, the first antenna element being in electrical communication with an RF signal source; and a first inner support structure disposed adjacent to the first antenna element; and a second half having:

a second outer skin having an inner surface;

a second electrically conductive antenna element disposed adjacent to the inner surface of the second outer skin, the second antenna element being in electrical communication with the RF signal source; and a second inner support structure disposed adjacent to the antenna element;

wherein the first inner support structure and the second inner support structure are bonded together to form the structural endcap antenna.

17. The endcap antenna of claim 16 wherein the first and second outer skins, the first and second antenna elements, and the first and second inner support structures are configured to be structural elements of the endcap when bonded together.

18. The endcap antenna of claim 17 wherein the first and second antenna elements are copper mesh.

19. The endcap antenna of claim 18 wherein the first and second inner support structures are a honeycomb structure.

20. The endcap antenna of claim 19 further comprising a bond between the first half and the second half of the endcap antenna that permits electrical conductivity between the first half and the second half.

21. The endcap antenna of claim 17 wherein the first and second antenna elements are graphite.

22. The endcap antenna of claim 16 wherein:

the first inner support structure comprises a conductive portion and a non-conductive portion; and the second inner support structure comprises a conductive portion and a non-conductive portion.

23. The endcap antenna of claim 22 wherein the conductive portion of the first inner support structure is disposed adjacent to the first antenna element and the conductive portion of the second inner support structure is disposed adjacent to the second antenna element.

24. The endcap antenna of claim 23 wherein the conductive portion of the first and second inner support structures is an aluminum honeycomb structure and the non-conductive portion of the first and second inner support structures is a glass honeycomb structure.

25. The endcap antenna of claim 16 wherein the endcap antenna has a bottom end when the first and second halves are bonded together and the endcap antenna further comprise an end rib disposed adjacent to the bottom end thereof.

26. The endcap antenna of claim 25 wherein the end rib is configured to be a ground plane for the first and second antenna elements.

27. The endcap antenna of claim 26 wherein the end rib is fabricated from graphite.

28. The endcap antenna of claim 27 wherein the end rib is fabricated from fiberglass having an electrically conductive finish.

29. A structural endcap antenna for a vertical tail of an aircraft, the endcap antenna comprising:

a center fiberglass section having a first surface and a second surface;

a first antenna element and a second antenna element, each of the first and second antenna elements disposed in laminar juxtaposition with a respective first and second surface of the center fiberglass section;

a first support structure and a second support structure, each of the first and second support structures disposed in laminar juxtaposition with a respective one of the first and second antenna elements; and a first and second outer skin, each of the first and second outer skins disposed in laminar juxtaposition with a respective one of the first and second support structures;

wherein the first and second outer skins, the first and second support structures, the first and second antenna elements, and the center fiberglass section form the structural endcap antenna for the vertical tail of the aircraft.

30. The endcap antenna of claim 29 wherein:

the first and second antenna elements are copper mesh;

the first and second support structures are a honeycomb support structure; and the first and second outer skins are fiberglass outer skins.

31. The endcap antenna of claim 30 wherein the first and second copper mesh, the first and second support structure and the first and second outer skin are bonded together with an adhesive.

32. The endcap antenna of claim 29 wherein the first and second support structures each comprise a conductive portion and a non-conductive portion.

33. The endcap antenna of claim 32 wherein the conductive portion is aluminum honeycomb and the non-conductive portion is glass honeycomb.

34. The endcap antenna of claim 29 wherein the first and second antenna elements are graphite.

35. A method of forming a structural endcap antenna for a vertical tail of an aircraft, the method comprising the steps of:

forming a first outer skin having an interior surface;

bonding a first antenna element to the inner surface of the first outer skin;

bonding a first support structure to the first antenna element;

bonding a second support structure to the first support structure;

bonding a second antenna element to the second support structure; and bonding a second outer skin to the second antenna element;

wherein the first and second outer skins, the first and second antenna elements and the first and second support structure form the structural endcap antenna.

36. The method of claim 35 further comprising the step of bonding a fiberglass section between the first and second support structures.

37. The method of claim 35 wherein the first an second antenna elements are bonded between the first and second support structures.

* * * * *